US005282007A

United States Patent [19]

Oshiumi

[11] Patent Number: 5,282,007

[45] Date of Patent: Jan. 25, 1994

[54] CLEANERLESS IMAGE FORMING METHOD

[75] Inventor: Koichiro Oshiumi, Kyoto, Japan

[73] Assignee: Murata Kikai Kabushiki Kaisha, Kyoto, Japan

[21] Appl. No.: 903,150

[22] Filed: Jun. 24, 1992

[30] Foreign Application Priority Data

Jun. 25, 1991 [JP] Japan ..... 3-153057

[51] Int. Cl.[5] ..... G03G 21/00

[52] U.S. Cl. ..... 355/296; 355/270; 355/274

[58] Field of Search ..... 355/296, 297, 269, 270, 355/274, 301, 302; 118/652

[56] References Cited

U.S. PATENT DOCUMENTS

| | | | |
|---|---|---|---|
| 4,664,504 | 5/1987 | Oda et al. . | |
| 4,769,676 | 9/1988 | Mukai et al. | 118/652 X |
| 4,800,147 | 1/1989 | Savage | 355/300 X |
| 5,055,882 | 10/1991 | Fushimi | 355/269 |
| 5,057,873 | 10/1991 | Sawai et al. | 355/301 X |
| 5,066,982 | 11/1991 | Hosoya et al. | 355/269 |
| 5,122,838 | 6/1992 | Kohyama | 355/269 |

FOREIGN PATENT DOCUMENTS

| | | | |
|---|---|---|---|
| 0134438 | 10/1979 | Japan | 355/270 |
| 0095575 | 5/1987 | Japan | 355/270 |

*Primary Examiner*—Leo P. Picard
*Assistant Examiner*—Christopher Horgan
*Attorney, Agent, or Firm*—Spensley Horn Jubas & Lubitz

[57] ABSTRACT

After a transferring process, a first predetermined voltage is applied to a transfer unit to charge a photosensitive drum surface to a first predetermined constant voltage. At the same time, a memory removing member is grounded. Therefore, a voltage difference is produced between the transfer unit and the memory removing member. This voltage difference causes the toner remaining on the memory removing member to be transferred to the photosensitive drum. In other words, the toner remaining on the memory removing member is redeveloped on the photosensitive drum whereby the cleaning of the memory removing member is conducted. Here, the memory removing member is a device for removing the toner from the photosensitive drum.

9 Claims, 4 Drawing Sheets

CLEANERLESS IMAGE FORMING METHOD

BACKGROUND OF THE INVENTION

1. Technical Field

The present invention relates to a method of forming an image without a cleaner and particularly to such a method which may be applied to a copying machine such as laser printers and photocopying machines using electrophotographic technology.

2. Background Art

Generally, when the above mentioned type of copying machine is used, image information is exposed onto a photosensitive drum to form an electrostatic latent image on an exposed portion and then toner is fed to the latent image to form a visible image (toner image). After that, the toner image is transferred to a sheet of paper by a transfer unit to obtain a copy.

The toner remaining on the photosensitive drum (some toner is not transferred to the paper) must be completely removed from the surface of the photosensitive drum. Otherwise, the quality of the next copy suffers considerably. Therefore, generally the photosensitive drum which has completed the image transferring step is cleaned prior to the next copying procedure. The cleaning is usually conducted by a cleaner provided at a lateral portion of the photosensitive drum. The cleaner has a blade which scrapes the remaining toner off the photosensitive drum. The scraped off toner is then guided into a collecting room by a guide sheet which extends below the blade.

Some copying machines employ a conventional image forming method which does not have a cleaner. In such a copying machine, a developing unit performs a developing process as well as a toner recovering process. Specifically, the toner remaining on the photosensitive drum is collected by the developing unit. After the transferring step, a memory removing member such as brush and electroconductive rubber roller is applied to the photosensitive drum to smudge and spread the toner remaining on the photosensitive drum even when image transferring has not taken place. This spreading step is referred to as "memory erasure step" in this particular specification. The remaining toner image left by the unused image transfer toner is erased in this way. Next, the photosensitive drum, used in the following image forming steps of charging and exposing, proceeds to the developing step.

FIG. 4 of the accompanying drawings shows the relative setting voltages of various components of a copying machine which employs a conventional image forming method without a cleaner. As seen in the illustration, the setting voltages have the following relation: Charging voltage on the photosensitive drum surface ($V_0$)<Bias voltage of developing unit ($V_1$)<Voltage of a portion exposed by the exposing unit ($V_2$)<Zero volt (0 V)<Voltage of the photosensitive drum surface after the transfer and charge removal ($V_3$)<Voltage of memory removing member ($V_4$).

The potential difference between $V_1$ and $V_2$ causes the development. The potential difference between $V_2$ and $V_4$ causes the transferring. The potential difference between $V_3$ and $V_4$ causes the memory removal. Since the setting voltage of the memory removing member is higher than the photosensitive drum surface voltage after the transfer and charge removal, the toner remaining on the photosensitive drum surface is lifted on the memory removing member. Then, some toner overflows from the memory removing member and returns onto the photosensitive drum surface. In this way, the remaining toner image left on the photoelectric drum by the unused image transfer toner is erased.

FIG. 3(*c*) of the accompanying drawings is a time chart showing a printing sequence according to a conventional image forming method which does not have a cleaner. In this time chart, since the photosensitive drum is rotated at a time t1, a charging device and a charge-removing lamp are turned on simultaneously with the motor. At a time t2, i.e., when the motor reaches a predetermined revolution speed, the developing unit and the memory removing member are turned on, respectively. At a time t3, the transfer unit is turned on so as to transfer the toner onto the sheet. Then, at a time t5, i.e., when the transferring step is completed, the transfer unit is turned off. At a time t7, the motor is turned off, and accordingly the revolution speed of the motor drops and the motor stops at a time t8. At the same time (t8), the electric charger, the developing unit, the charge-removing lamp and the memory removing member are turned off, respectively.

According to the conventional copying machine which depends on the above described image forming method without a cleaner, "jamming" occurs, and at the time that the image forming process is interrupted, there is a large amount of toner left on the photosensitive drum ready for image transfer. When jamming is eliminated and the image forming process resumes in this state, the toner holding capacity of the memory removing member is greatly exceeded and its performance is considerably deteriorated. Specifically, the remaining toner image left by the unused image transfer toner cannot be sufficiently removed and an undesired situation arises, i.e., during the next image forming process, an old toner image remains. In addition, the toner held in the memory removing member overflows from the memory removing member and stains peripheral elements and the sheet under the photosensitive drum etc.

Even if jamming does not occur, it is unavoidable that the memory performance will lower as the image forming process is repeated frequently. Therefore, the conventional without-cleaner image forming method actually needs a cleaning step for the memory removing member at an appropriate time.

SUMMARY OF THE INVENTION

The present invention intends to eliminate the above-described problems and its primary object is to provide an image forming method without a cleaner (referred to as "cleanerless image forming method"), which can maintain the memory removal performance at a certain level and insure a sufficient cleaning ability and greatly improved image quality.

According to one aspect of the present invention, there is provided a cleanerless image forming method comprising the steps of (A) performing a normal transferring process, (B) applying a first predetermined voltage to a transfer unit to charge an image holding body surface to a first predetermined constant voltage, (C) controlling the voltage of a memory removing member to be lower than the charge voltage of the image holding body, (D) redeveloping a toner remaining on the memory removing member, onto the image holding body surface, (E) monitoring jamming, (F) eliminating jamming if it is detected, (G) applying a second predetermined voltage to the transferring unit to charge the image holding unit surface to a second predetermined constant voltage, (H) controlling the voltage of the memory removing member to be lower than the charge voltage of the image holding body and (I) redeveloping the toner remaining on the memory removing member, onto the image holding body surface. A series of steps (A)-(D) is referred to as a first executive step and another series of steps (E)-(I) is referred to as a second executive step.

According to the above described method, when the normal image forming process is performed, the first executive step is conducted after the transferring process. In the first executive step, a first predetermined voltage is applied to the transfer unit such that surface of the image holding body which faces the transfer unit is charged to a first constant voltage. At the same time, the voltage of the memory removing member is set to be lower than the charge voltage of the image holding body. Then, the toner remaining on the memory removing member is transferred onto the image holding body because of the voltage difference between the memory removing member and the image holding member surface. In other words, the toner remaining on the memory removing member is redeveloped on the surface of the image holding member and as a result the cleaning of the memory removing member is conducted.

The jamming monitoring step is always conducted to find jamming. When jamming occurs, it is first eliminated and then the first executive step is carried out. Thereafter the next image forming is conducted. The first executive step is substantially the same as the second executive step.

BRIEF DESCRIPTION OF THE DRAWING

FIG. 3(*b*) shows an after-jam-elimination printing sequence which also employs the cleanerless image forming method of the present invention, and FIG. 3(*c*) shows a printing sequence which employs a conventional image forming method.

DETAILED DESCRIPTION OF THE PREFERRED EMBODIMENTS

Now, a preferred embodiment of the present invention will be described with reference to FIGS. 1-3 of the accompanying drawings.

Figure 1:
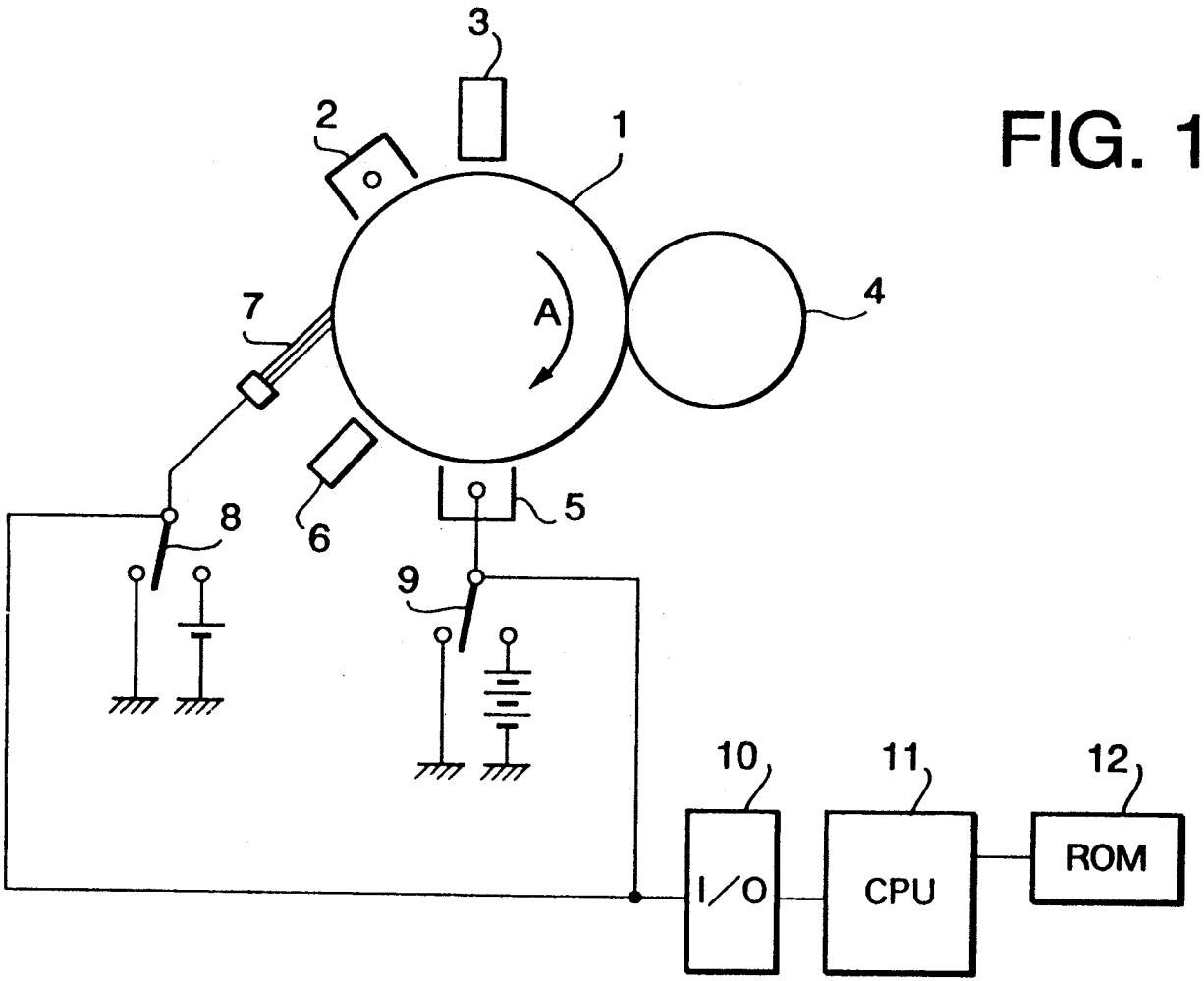
FIG. 1 shows major elements of an image forming apparatus to which a cleanerless image forming method of the present invention is applied.

Referring to the block diagram of FIG. 1, illustrated are major components of an image forming apparatus to which a cleanerless image forming method of the present invention is applied. The image forming apparatus includes a photosensitive drum 1 which rotates in a direction as indicated by the arrow A, an electric charger 2 which charges the surface of the photosensitive drum 1 to a certain constant voltage, an exposing unit 3 which exposes the charged surface of the photosensitive drum which writes the image information in the form of electrostatic latent image, a developing unit 4 which feeds the toner to the electrostatic latent image to obtain a toner image (visible image), a transfer unit 5 which transfers the toner image to a sheet, a charge-removing lamp 6 which exposes the surface of the photosensitive drum 1 to remove the charge from the photosensitive drum and a memory removing member 7 which smudges and spreads the non-used remaining toner on the photosensitive drum. The developing unit 4 performs a toner recovering process in addition to a developing process which is its original duty. The toner is spread on the surface of the photosensitive drum 1 by the memory removing member 7 and is recovered by the developing unit 4 during the toner recovery process.

The memory removing member 7 is plus charged or grounded by selectively manipulating a first switch 8. Likewise, the transfer unit 5 is plus charged or grounded by selectively manipulating a second switch 9. These switches 8 and 9 are connected to a CPU 11 via a I/O port 10 and supervised by the CPU 11 based on a program stored in a ROM 12.

Specifically, when a certain time comes (to be described later), the CPU 11 activates the switch 9 to energize a plus voltage to the transfer unit 5 so as to charge the photosensitive drum surface to a predetermined voltage. Further, the switch 8 is activated to ground the memory removing member 7. As a result, the voltage of the memory removing member 7 is lower than the surface voltage of the photosensitive drum 1 (In this case, the voltage of the memory removing member 7 is zero since it is connected to the ground.). Therefore, there is a voltage difference between these two elements 7 and 1. Consequently, the memory removing member 7 does not lift or absorb the toner from the photosensitive drum 1 (nor does the memory removing member 7 perform the memory removing step) and the toner held by the memory removing member 7 is redeveloped on the photosensitive drum surface again. An on/off timing of the memory removing member 7 and the transfer unit 5 will be described with FIG. 3.

Figure 2:
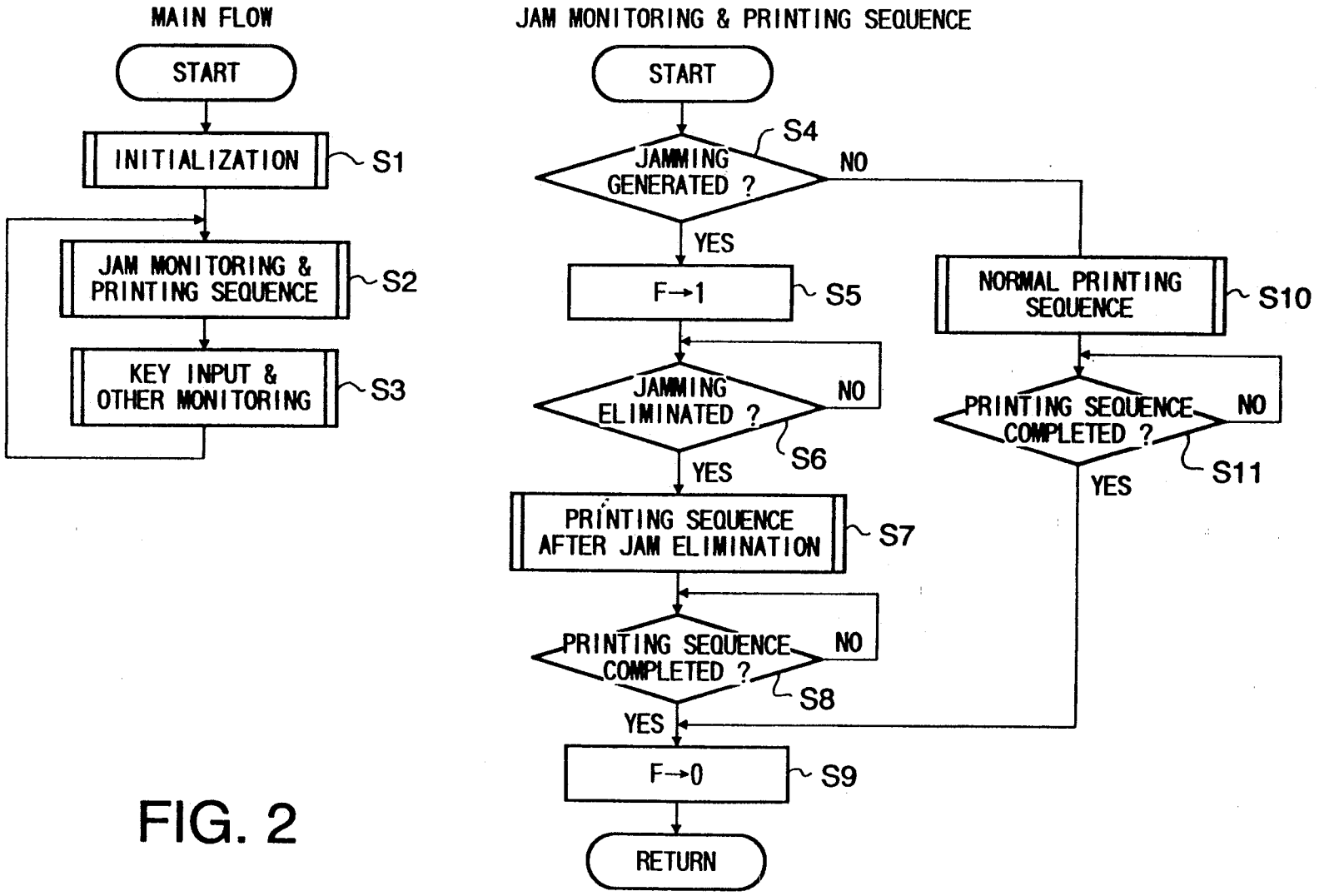
FIG. 2 is a set of flow charts showing a process of the cleanerless image forming method according to the present invention.

FIG. 2 is a flow chart showing a process of cleanerless image forming method according to the present invention. As a main flow, first the initialization of the system is performed for the image forming (S1) and then a sub routine of the jam monitoring and printing sequence is performed (S2). Further, another subroutine for monitoring inputs of various keys, and so on, is carried out (S3). At step S2, jamming is monitored while the printing sequence is performed. Fundamentally, the cleanerless image forming method proceeds with this main flow.

Next, the subroutine of jam monitoring and printing sequence will be described. According to this subroutine, first the jamming is detected (S4), and if it is detected (Yes at S4), a flag F is set to 1 (S5). Then, when jamming is eliminated (Yes at S6), the printing sequence after jamming elimination is carried out (S7). After this sequence (Yes at S8), the flag F is set to 0 (S9). If there is no jamming (No at S5), the normal printing sequence is carried out (S10). After this sequence (Yes at S11), the flag F is set to 0 (S9).

The printing sequence after jamming elimination and the normal printing sequence will be described with the time charts of FIG. 3.

Figure 3A:
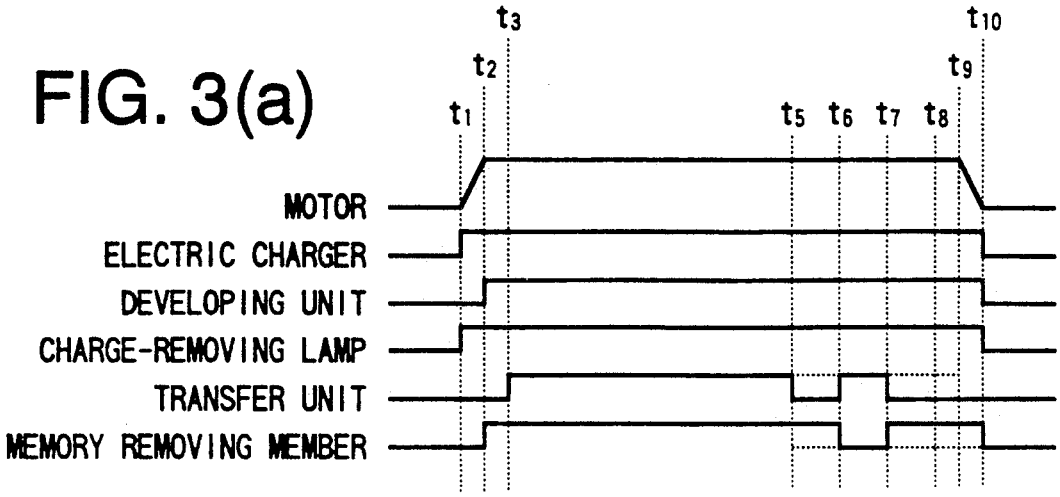
FIG. 3 is a set of time charts, in which FIG. 3(*a*) shows a normal printing sequence which employs the cleanerless image forming method of the present invention.
Figure 3B:
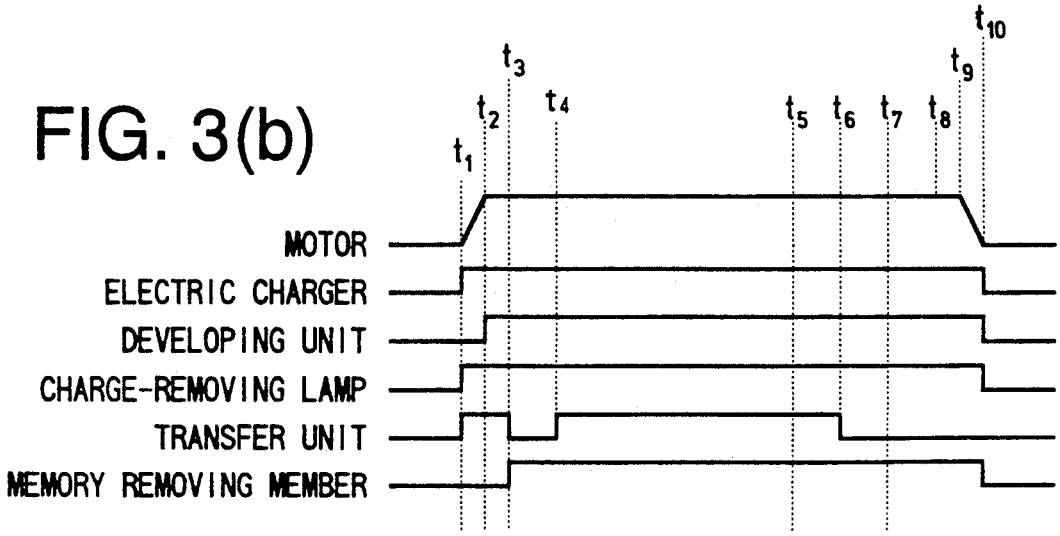
Figure 3C:
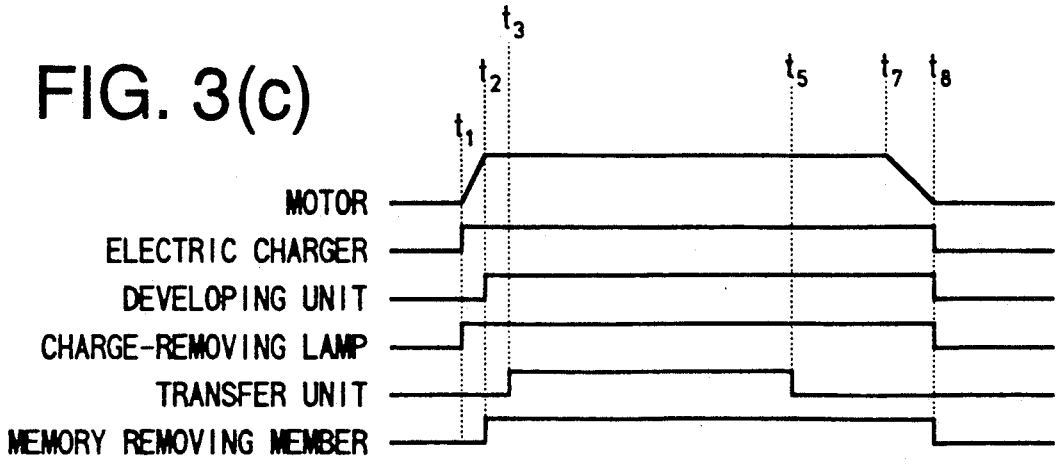
Figure 4:
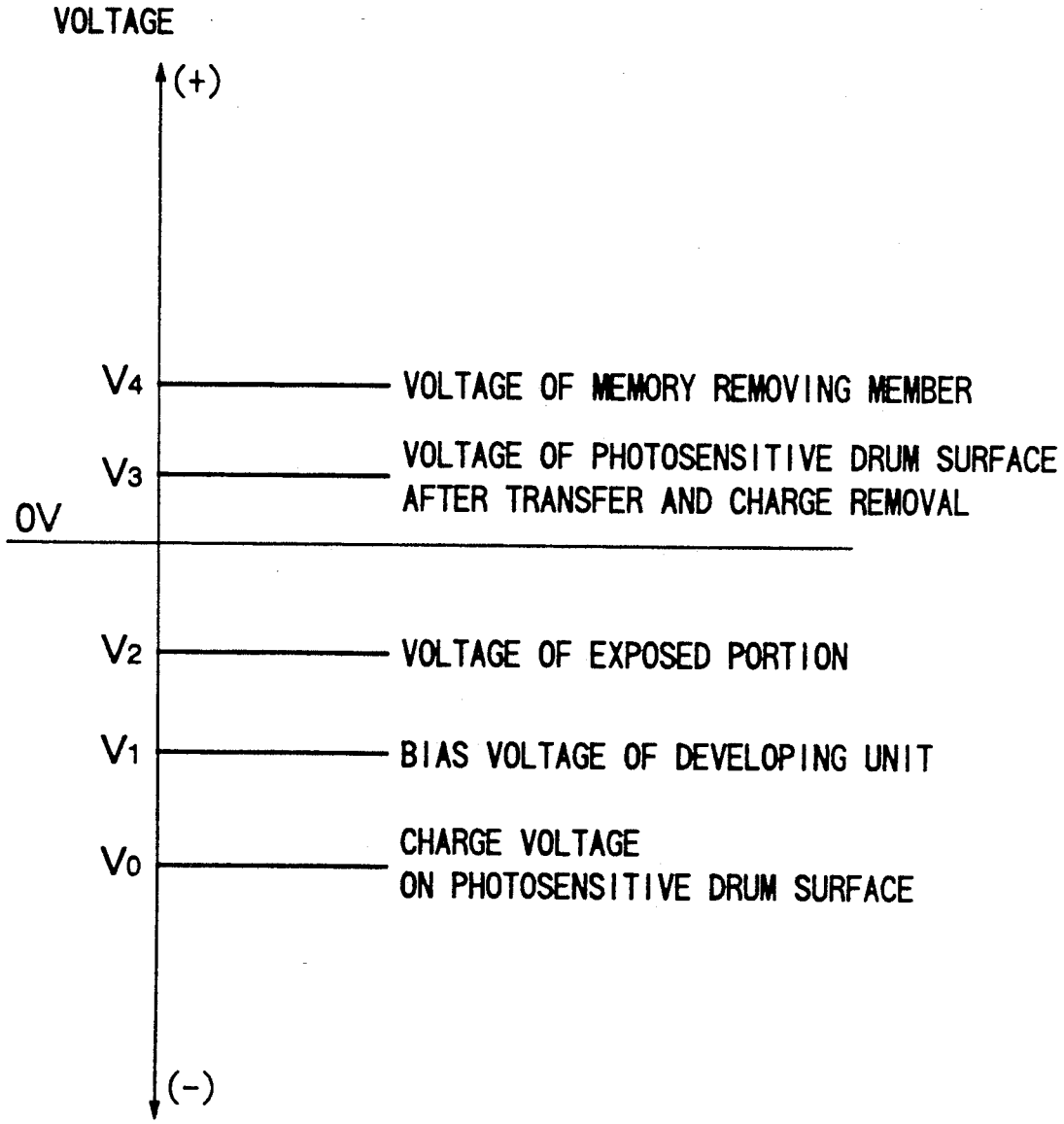
FIG. 4 PRIOR ART
FIG. 4 depicts the relationship between setting voltages of various pieces of equipment of a copying machine which operates with a conventional cleanerless image forming method.

FIGS. 3(*a*) and 3(*b*) are the time charts showing the printing sequence according to the present invention, respectively. FIG. 3(*a*) illustrates the normal printing sequence which is selected when no jamming is detected. FIG. 3(*b*) illustrates the printing sequence after jamming is eliminated. As understood from the flow chart of FIG. 2, one of these two printing sequences is selectively carried out based on the occurrence of jamming. As clear from FIG. 3, these printing sequences (FIGS. 3(*a*) and 3(*b*)) have longer total activation period of time as compared with the conventional printing sequence (FIG. 3(*c*)). This is because an additional procedure which is unique to the present invention is performed to the transfer unit 5 and the memory removing member 7 as compared with the conventional printing sequence.

Various equipment which is necessary to the image forming will now be explained with reference to the time charts. First, the normal printing sequence shown in FIG. 3(*a*) will be explained. In the time chart of FIG. 3(*a*), since the photosensitive drum 1 is rotated at a time t1, the electric charger 2 and the charge-removing lamp 6 are turned on (or activated) as the motor is turned on. Then, at a time t2 (when the motor reaches a predetermined rotational speed), the developing unit 4 and the memory removing member 7 are turned on. After that, the transfer unit 5 is turned on at a time t3 to transfer the toner onto the sheet. Subsequently, the transfer unit 5 is turned off (deactivated) as the transferring step is completed. Then, the transfer unit 5 is turned on again at a time t6 whereas the memory removing member 7 is turned off. At a time t7, the transfer unit 5 is turned off and the memory removing member 7 is turned on. At a time t9, the motor is turned off and eventually its rotational speed decreases. The motor stops at a time t10. At the same time (t10), the electric charger 2, the developing unit 4, the charge-removing lamp 6 and the memory removing member 7 are turned off.

If the printing sequence is carried out in line with the time chart of FIG. 3(*a*), the transfer unit 5 is always turned on and the memory removing member 7 is simultaneously turned off, when a predetermined period of time elapses after the normal printing. In other words, a predetermined plus bias voltage is once again applied to the transfer unit 5 and that surface of the photosensitive drum 1 which faces the transfer unit 5 is charged to a constant voltage. At the same time, the memory removing member 7 is grounded and its voltage becomes zero. Therefore, after the printing (or after the toner image is transferred to the sheet from the photosensitive drum 1), a voltage difference appears between the photosensitive drum 1 and the memory removing member 7. Consequently, the toner held by the memory removing member 7 is transferred to the surface of the photosensitive drum 1 and the redevelopment starts. In this way, the cleaning of the memory removing member 7 is performed every time the printing process finishes.

Next, the printing sequence after the jam elimination will be explained with reference to FIG. 3(*b*). The motor, electric charger 2, developing unit 4 and charge-removing lamp 6 operate in the same manner as shown in the time chart of FIG. 3(*a*). A feature of this printing sequence is that the transfer unit 5 and motor are turned on simultaneously because the photosensitive drum 1 rotates at the time t1. Further, the memory removing member 7 is turned on at the same time the transfer unit 5 is turned off at the time t3. After that, the transfer unit 5 is turned on again at the time t4 and turned off at the time t6. The memory removing member 7 is turned off at the time t10, at which time the motor stops. Incidentally, the sequence indicated by the broken line in FIG. 3(*a*) is also possible.

If the printing sequence is carried out in line with the time chart of FIG. 3(*b*), the transfer unit 5 is turned on as the motor is turned on, before the printing process resumes after the jam elimination. Specifically, a predetermined plus voltage is applied to the transfer unit 5 and that face of the photosensitive drum 1 which faces the transfer unit 5 is charged to a constant voltage. At this time, the memory removing member 7 is in the off state, i.e., the memory removing member 7 is grounded and has zero voltage. Thus, a voltage difference appears between the photosensitive drum 1 and the memory removing member 7, and the toner which stays on the memory removing member 7 is transferred to the surface of the photosensitive drum 1 so as to cause the development there.

When the above mentioned voltage relationship is maintained, the non-used remaining toner on the photosensitive drum 1 is not lifted by the memory removing member 7. Therefore, the memory removing member 7 does not process toner beyond its capacity and the overflow of the toner from the memory removing member would not occur. Consequently, sufficient cleaning of the memory removing member 7 is insured. After the cleaning of the memory removing member 7, the memory removing member 7 is turned on as the transfer unit 5 is turned off, and further, the normal printing sequence is performed and the memory removing step by the memory removing member 7 is performed.

According to the present invention, when the normal image forming is carried out, the memory removing member is always cleaned after every transferring step. Thus, sufficient memory removing performance is maintained.

In addition, the generation of jam is monitored and when jamming is detected, the cleaning of the memory removing member is conducted before next image forming process starts. Therefore, the memory removal performance is not deteriorated in the following image forming process. Further, since the memory removing member does not process the toner beyond its capacity, the toner never overflows from the memory removing member and the elements near the photosensitive drum are not stained.

As compared with the conventional method, the cleanerless image forming method of the present invention can improve the quality of the image remarkably. In addition, a smooth image formation is insured, i.e., the period of time between a printer activation and an output of first sheet becomes shorter.

We claim:

1. An image forming apparatus, comprising:

a photosensitive drum having a surface;

an electric charger for charging the surface of the photosensitive drum to a first predetermined voltage;

an exposing unit for exposing the charged surface of the photosensitive drum such that a latent image is formed on the surface of the photosensitive drum;

a developing unit for feeding toner to the latent image to form a toner image;

a transfer unit for transferring the toner image to a recording medium;

a charge-removing lamp for exposing the surface of the photosensitive drum such that the charge of the surface of the photosensitive drum is removed;

a memory removing member for smudging and spreading the toner remaining on the photosensitive drum; and a first switch for selectively connecting the memory removing member to one of a first positive voltage source and ground, and a second switch for selectively connecting the transfer unit to one of a second positive voltage source and ground.

2. The image forming apparatus of claim 1, further comprising:

a controller operably connected to the switch, wherein the controller controls the first and second switches such that the transfer unit is operably connected to the first positive voltage source and the memory removing member is operably connected to ground.

3. An cleanerless image forming method for use with an apparatus including image holding surface, a transfer unit and a memory removing member, the method comprising the steps of:

(A) performing a normal transferring process, the normal transferring process defining a beginning and an end;

(B) applying a voltage to the transfer unit for a first predetermined period beginning after the end of the normal transferring process, the transfer unit charging the image holding surface to a first predetermined voltage;

(C) controlling a voltage of the memory removing member such that the voltage of the memory holding member is substantially less than the first predetermined voltage during the first predetermined period;

(D) redeveloping toner remaining on the memory removing member onto the image holding surface during the first predetermined period;

(E) monitoring the apparatus to detect a jam and to determine when the jam has been eliminated;

(F) applying a voltage to the transfer unit for a second predetermined period beginning after the jam has been eliminated, the transfer unit charging the image holding surface to a second predetermined voltage;

(G) controlling a voltage of the memory removing member such that the voltage of the memory holding member is substantially less than the second predetermined voltage during the second predetermined period; and (H) redeveloping the toner remaining on the memory removing member onto the image holding surface during the second predetermined period.

4. An image forming method for use with an image forming apparatus, the image forming apparatus including a photosensitive drum having a surface, a motor adapted to rotate the photosensitive drum, an electric charger for charging the surface of the photosensitive drum to a constant voltage, an exposing unit for exposing the charged surface of the photosensitive drum such that a latent image is formed on the surface of the photosensitive drum, a developing unit for feeding toner to the latent image to form a toner image, a transfer unit for transferring the toner image to a recording medium, a charge-removing lamp for exposing the surface of the photosensitive drum such that the charge of the surface of the photosensitive drum is removed, and a memory removing member for smudging and spreading the toner remaining on the photosensitive drum, the method comprising the steps of:

(A) initializing the image forming apparatus;

(B) monitoring the apparatus for a jamming;

(C) activating the motor to rotate the photosensitive drum, activating the electric charger and activating the charge-removing lamp, if jamming is not monitored in step (B);

(D) activating the developing unit and memory removing member when the motor reaches a predetermined revolution speed;

(E) activating the transfer unit to transfer the toner image onto a sheet;

(F) deactivating the transfer unit when the transferring step (E) is completed;

(G) activating the transfer unit by applying a positive voltage to the transfer unit and deactivating the memory removing member by applying zero voltage to the memory removing member such that a voltage difference is produced between the transfer unit and the memory removing member and toner on the memory removing member is transferred to the photosensitive drum;

(H) deactivating the transfer unit and activating the photosensitive drum after at least a portion of the toner has been transferred from the memory removing member to the photosensitive drum;

(I) deactivating the motor; and (J) deactivating the electric charger, developing unit, charge-removing lamp and memory removing member when the motor stops.

5. The image forming method of claim 4, further comprising the steps of:

(K) determining when a jam monitored at step (B) has been eliminated; and (L) activating the motor to rotate the photosensitive drum, activating the electric charger, activating the charge-removing lamp, activating the transfer unit by applying a positive voltage to the transfer unit, and deactivating the memory removing member so as to apply a zero voltage to the memory removing member, whereby a voltage difference is produced between the photosensitive drum and the memory removing member which transfers the toner to the photosensitive drum from the memory removing member.

6. An image forming apparatus, comprising:

a photosensitive drum having a surface, the surface adapted to carry a toner image;

transfer means for transferring the toner image from the photosensitive drum to a recording medium, the transfer means defining a transfer means voltage;

memory removing means for erasing a toner image remaining on the photosensitive drum after a toner transfer, the memory removing means defining a memory removing means voltage; and control means for decreasing the transfer means voltage to end the toner transfer, for increasing the transfer means voltage during a predetermined period occurring after the end of the toner transfer and prior to a next toner transfer, and for decreasing the memory removing means voltage during the predetermined period.

7. The image forming apparatus of claim 6, wherein the control means comprises switch means for respectively connecting the transfer means to a positive voltage source and the memory removing means to ground during the predetermined period.

8. An image forming apparatus, comprising:

a photosensitive drum having a surface, the surface adapted to carry a toner image;

transfer means for transferring the toner image from the photosensitive drum to a recording medium, the transfer means defining a transfer means voltage;

memory removing means for erasing a toner image remaining on the photosensitive drum after a toner transfer, the memory removing means defining a memory removing means voltage; and control means for detecting when a jam has been eliminated, for increasing the transfer means voltage during a predetermined period occurring after the jam has been eliminated and prior to a next transfer of a toner image, and for decreasing the memory removing means voltage during the predetermined period.

9. The image forming apparatus of claim 8, wherein the control means comprises switch means for respectively connecting the transfer means to a positive voltage source and the memory removing means to ground during the predetermined period.

* * * * *